US008085204B2

(12) United States Patent
Wu et al.

(10) Patent No.: US 8,085,204 B2
(45) Date of Patent: Dec. 27, 2011

(54) ULTRA-WIDEBAND ANTENNA

(75) Inventors: Hsin-Tsung Wu, Taipei (TW); Kai Shih, Taipei (TW); Yu-Yuan Wu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 381 days.

(21) Appl. No.: 12/509,442

(22) Filed: Jul. 25, 2009

(65) Prior Publication Data

US 2011/0018781 A1 Jan. 27, 2011

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,781,546 | B2 * | 8/2004 | Wang et al. | 343/700 MS |
| 2007/0008224 | A1 * | 1/2007 | Chung et al. | 343/700 MS |
| 2007/0109199 | A1 * | 5/2007 | Hung et al. | 343/700 MS |
| 2007/0279288 | A1 * | 12/2007 | Liu | 343/700 MS |

* cited by examiner

*Primary Examiner* — Douglas W Owens
*Assistant Examiner* — Dieu H. Duong

(57) ABSTRACT

An ultra-wideband has an elongated grounding plate disposed horizontally with a long front edge defined thereon. A connecting portion extends upwards from an end of the front edge. A first antenna radiator includes a first radiating strip extended from a side of the connecting portion and a second radiating strip connecting with a free end of the first radiating strip. A third antenna radiator includes a third radiating strip suspended over the grounding plate, a fourth radiating strip connecting with an end of a long front edge of the third radiating strip and an upper side of the second radiating strip, a fifth radiating strip extended downwards from the long front edge of the third radiating strip connecting with the connecting portion. A third antenna radiator extends downwards from a middle of the long front edge of the third radiating strip. A feeding point disposes on the second radiating strip.

3 Claims, 3 Drawing Sheets

| | | |
|---|---|---|
| Mkr1 | 3.1GHz | 1.3994 |
| Mkr2 | 4.9GHz | 1.1310 |
| Mkr3 | 6.3GHz | 1.4601 |
| Mkr4 | 8.0GHz | 1.3604 |

ULTRA-WIDEBAND ANTENNA

BACKGROUND OF THE INVENTION

1. Field of the Invention

The invention relates to an ultra-wideband antenna, and particularly to an ultra-wideband antenna with a compact structure capable of covering multiple frequency bands.

2. The Related Art

Ultra-wideband (UWB) is a radio technology that can be used at very low energy levels for short-range high-bandwidth communications by using a large portion of the radio spectrum. With the development of wireless communication, more and more portable electronic devices are generally equipped with the ultra-wideband antennas for supporting wireless communication in multiple operating frequency bands. However, the conventional ultra-wideband antenna generally has a big size for meeting a requirement of multiple frequency bands, which is against miniaturization trend of the portable electronic device. So it is necessary to design an ultra-wideband antenna with a simple and compact structure capable of covering multiple frequency bands in the world.

SUMMARY OF THE INVENTION

An object of the present invention is to provide an ultra-wideband antenna with a compact structure capable of covering multiple frequency bands.

The ultra-wideband antenna has an elongated grounding plate disposed horizontally. The grounding plate defines a long front edge thereon. A connecting portion is extended upwards from an end of the front edge of the grounding plate. A first antenna radiator has a first radiating strip, which is extended from a side of the connecting portion along an extending direction of the front edge of the grounding plate and spaced apart from the grounding plate, and a second radiating strip extended opposite to the first radiating strip and upwards from a free end of the first radiating strip, with a free end thereof flushing with an end of the grounding plate. A feeding point is arranged on the second radiating strip of the first antenna radiator and adjacent to the first radiating strip. A second antenna radiator includes a third radiating strip suspended over and substantially parallel with the grounding plate, with one end of a long front edge thereof connected with a free end of the connecting portion, a fourth radiating strip connecting with the other end of the long front edge of the third radiating strip and an upper side of the second radiating strip, and a fifth radiating strip extended downwards from the long front edge of the third radiating strip. The fifth radiating strip connects with the connecting portion and spaces apart from the first radiating strip. A third antenna radiator connects with a substantially middle portion of the long front edge of the third radiating strip and an upper side of the first radiating strip.

As described above, the ultra-wideband antenna has a simple and compact structure, which suits the miniaturization development of the portable electronic device and reduces the manufacture cost. Meanwhile, the ultra-wideband antenna has excellent and improvable performances in frequency bands ranging from 3.1 to 4.9 GHz, 4.9 to 6.3 GHz and 6.3 to 8.0 GHz.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE EMBODIMENT

Figure 1:
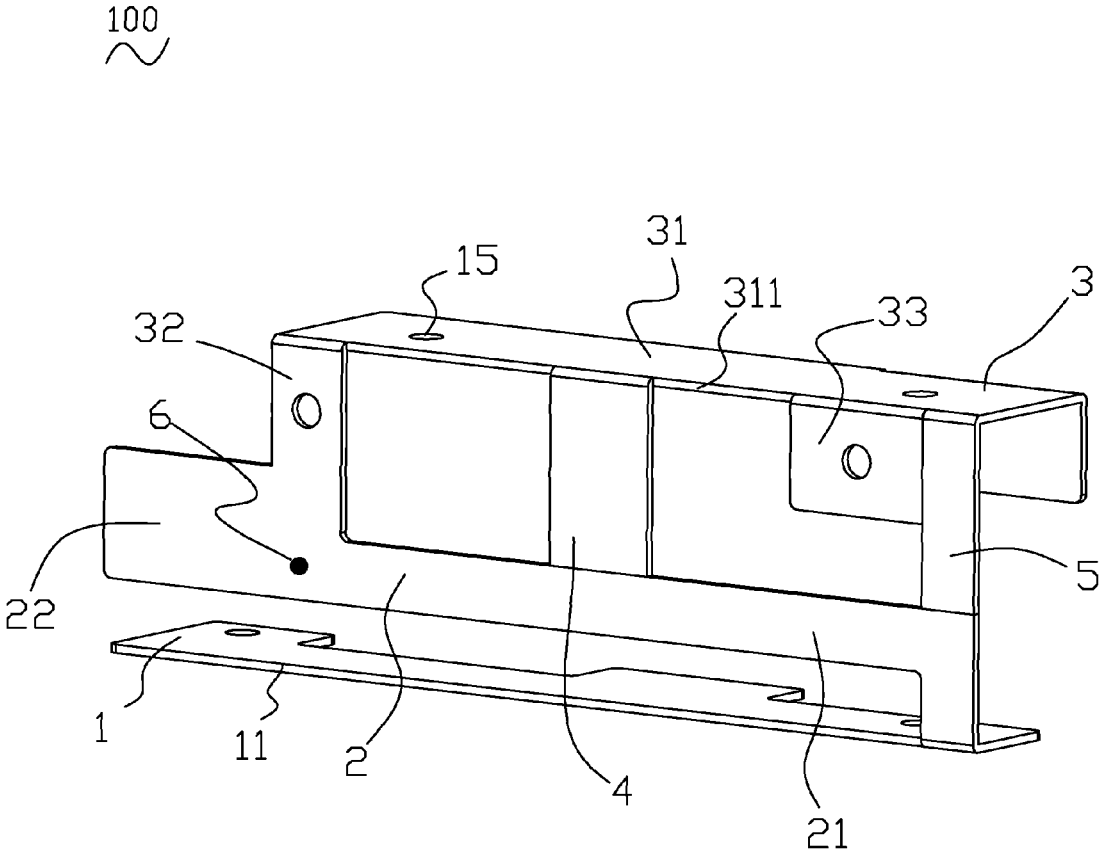
FIG. 1 is a perspective view of an ultra-wideband antenna according to the present invention.

Please refer to FIG. 1, the embodiment of an ultra-wideband antenna 100 according to the present invention is shown. The ultra-wideband antenna 100, which may be punched from a sheet metal, includes an elongated grounding plate 1, a first antenna radiator 2, a second antenna radiator 3, a third antenna radiator 4, a connecting portion 5 and a feeding point 6.

Figure 2:
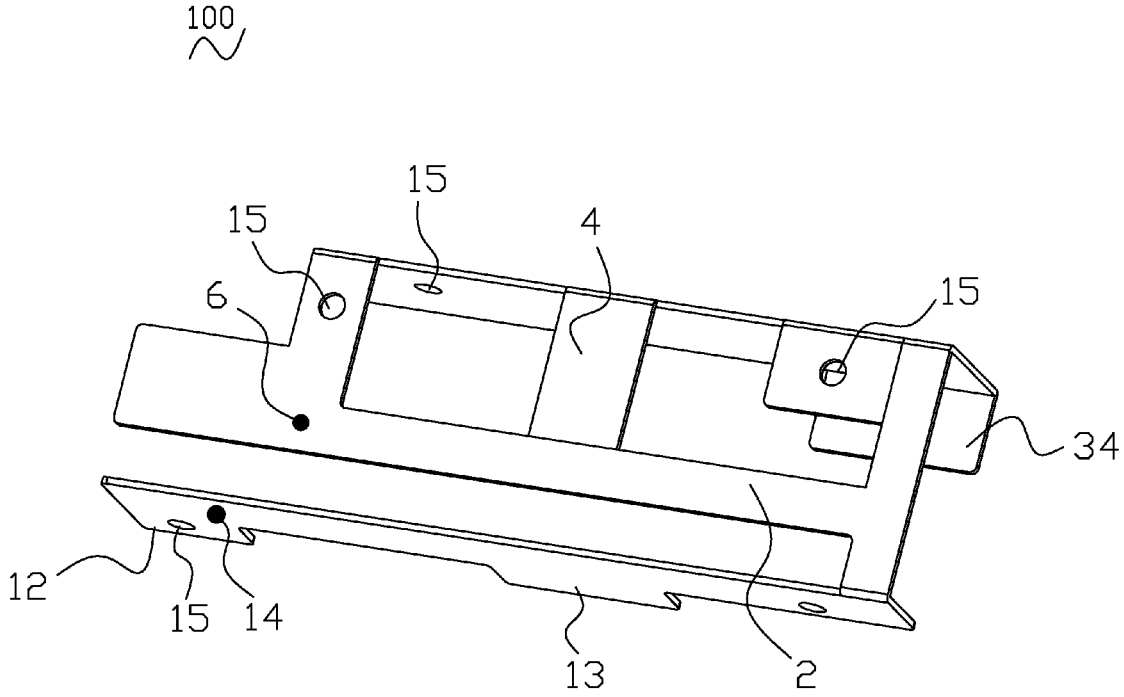
FIG. 2 is a perspective view of the ultra-wideband antenna shown in FIG. 1 seen from anther direction.

Please refer to FIG. 1 and FIG. 2, the grounding plate 1 is an elongated shape and disposed horizontally. A long side of the grounding plate 1 is defined a front edge 11. A rear edge of the grounding plate 1 opposite to the front edge 11 is extended rearward to form a first fixing portion 12 at an end thereof and a second fixing portion 13 at a middle portion thereof. The first fixing portion 12 and the second fixing portion 13 are spaced away from each other and capable of attaching with the electronic device (not shown). A grounding point 14 is disposed on a bottom of an end of the grounding plate 1 adjacent to the first fixing portion 12. The front edge 11 has an end away from the grounding point 14 extending upwardly and perpendicularly to form the connecting portion 5.

The first antenna radiator 2 has a first radiating strip 21, which is extended from a side of the connecting portion 5 along an extending direction of the front edge 11 of the grounding plate 1 and spaced apart from the grounding plate 1, and a second radiating strip 22, which is extended opposite to the first radiating strip 21 and upwards from a free end of the first radiating strip 21, with a free end thereof flushing with an end of the grounding plate 1. The feeding point 6 is arranged on the second radiating strip 22 and adjacent to the first radiating strip 21.

The second antenna radiator 3 includes an elongated third radiating strip 31 suspended over and substantially parallel with the grounding plate 1, with one end of a long front edge 311 thereof connected with a free end of the connecting portion 5, a fourth radiating strip 32 which is extended downwards from the other end of the long front edge 311 of the third radiating strip 31 and connects with an upper side of the second radiating strip 22, and a fifth radiating strip 33 extended downwards from the long front edge 311 of the third radiating strip 31, which connects with the connecting portion 5 and is spaced apart from the first radiating strip 21 with a predetermined distance. In this embodiment, the third radiating strip 31 is shorter than the grounding plate 1 in length. The fourth radiating strip 32 connects with an end of the upper side of the second radiating strip 22 adjacent to the first radiating strip 21. The long front edge 311 of the third radiating strip 31 has a substantial middle portion extended downwards to form the third antenna radiator 4, with a free end thereof connecting with an upper side of the first radiating strip 21. A rear edge of the third radiating strip 31 opposite to the long front edge 311 has an end extended downwards to form a third fixing portion 34, substantially facing to the fifth radiating strip 33, for mating with the electronic device. In this embodiment, the grounding plate 1, the third radiating strip 31, the fourth radiating strip 32 and the fifth radiating strip 33 are punched with fixing holes 15 thereon, for fixing the ultra-wideband antenna 100 on the electronic device firmly.

When the ultra-wideband antenna 100 operates at a wireless communication environment, a current is fed from the feeding point 6 to the first antenna radiator 2 to generate an electronic resonance corresponding to frequency band ranging between 6.3 GHz and 8.0 GHz. While the current is fed from the feeding point 6 to the second antenna radiator 3 to generate an electronic resonance corresponding to frequency band ranging between 3.1 GHz and 4.9 GHz. While the current is fed from the feeding point 6 to the third antenna radiator 4 to generate an electronic resonance corresponding to frequency band ranging between 4.9 GHz and 6.3 GHz.

Figure 3:
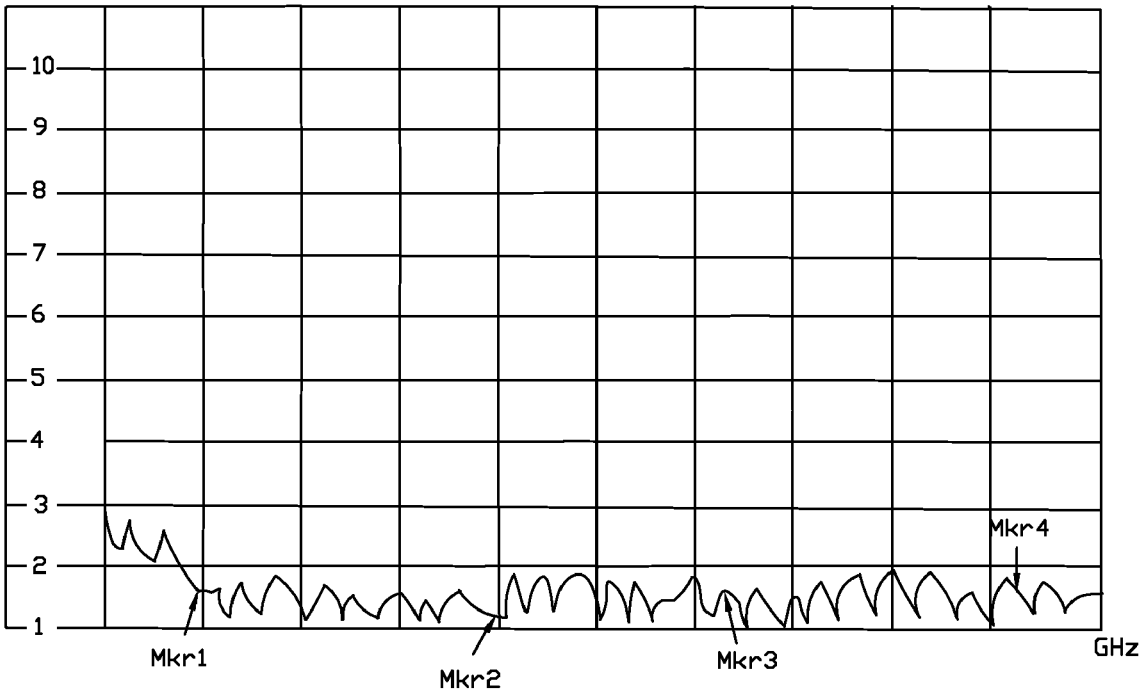
FIG. 3 shows a Voltage Standing Wave Ratio (VSWR) test chart of the ultra-wideband antenna shown in FIG. 1.

Please refer to FIG. 3, which shows a Voltage Standing Wave Ratio (VSWR) test chart of the ultra-wideband antenna 100 in the embodiment when the ultra-wideband antenna 100 operates at a wireless communication environment. When the ultra-wideband antenna 100 operates at 3.1 GHz (indicator Mkr1 in FIG. 3), the VSWR value is 1.3994. When the ultra-wideband antenna 100 operates at 4.9 GHz (indicator Mkr2 in FIG. 3), the VSWR value is 1.1310. When the ultra-wideband antenna 100 operates at 6.3 GHz (indicator Mkr3 in FIG. 3), the VSWR value is 1.4601. When the ultra-wideband antenna 100 operates at 8.0 GHz (indicator Mkr4 in FIG. 3), the VSWR value is 1.3604. The VSWR values of the ultra-wideband antenna 100 show that the ultra-wideband antenna 100 has an excellent frequency response between 3.1 GHz~6.3 GHz and between 6.3 GHz~8.0 GHz.

As described above, the ultra-wideband antenna 100 has a simple and compact structure, which suits the miniaturization development of the portable electronic device and reduces the manufacture cost. Meanwhile, the ultra-wideband antenna 100 has excellent and improvable performances in frequency bands ranging from 3.1 to 4.9 GHz, 4.9 to 6.3 GHz and 6.3 to 8.0 GHz.

Furthermore, the present invention is not limited to the embodiment described above; various additions, alterations and the like may be made within the scope of the present invention by a person skilled in the art. For example, respective embodiments may be appropriately combined.

What is claimed is:

1. An ultra-wideband antenna, comprising:

an elongated grounding plate disposed horizontally, the grounding plate defining a long front edge;

a connecting portion extending upwards from an end of the front edge of the grounding plate;

a first antenna radiator, the first antenna radiator having a first radiating strip, which is extended from a side of the connecting portion along an extending direction of the front edge of the grounding plate and spaced apart from the grounding plate, and a second radiating strip extended opposite to the first radiating strip and upwards from a free end of the first radiating strip, with a free end thereof flushing with an end of the grounding plate;

a feeding point arranged on the second radiating strip of the first antenna radiator, adjacent to the first radiating strip;

a second antenna radiator, the second antenna radiator including a third radiating strip suspended over and substantially parallel with the grounding plate, with one end of a long front edge thereof connected with a free end of the connecting portion, a fourth radiating strip connecting with the other end of the long front edge of the third radiating strip and an upper side of the second radiating strip, a fifth radiating strip extended downwards from the long front edge of the third radiating strip, the fifth radiating strip connecting with the connecting portion and being spaced apart from the first radiating strip; and a third antenna radiator connected with a substantially middle portion of the long front edge of the third radiating strip and an upper side of the first radiating strip.

2. The ultra-wideband antenna as claimed in claim 1, wherein a grounding point is disposed at an end of the grounding plate away from the connecting portion.

3. The ultra-wideband antenna as claimed in claim 1, wherein a rear edge of the grounding plate opposite to the front edge is extended rearwards to form a first fixing portion at an end thereof, and a second fixing portion at a middle portion thereof, the first fixing portion and the second fixing portion are spaced away from each other.

* * * * *